US006099332A

United States Patent [19]

Troyan

[11] Patent Number: 6,099,332

[45] Date of Patent: Aug. 8, 2000

[54] CONNECTOR WITH ADAPTABLE INSERT

[75] Inventor: Bruce Robert Troyan, Lake Oswego, Oreg.

[73] Assignee: The Whitaker Corp., Wilmington, Del.

[21] Appl. No.: 09/084,719

[22] Filed: May 26, 1998

[51] Int. Cl.[7] ..... H01R 29/00

[52] U.S. Cl. ..... 439/176

[58] Field of Search ..... 439/172, 173, 439/174, 175, 176

[56] References Cited

U.S. PATENT DOCUMENTS

| | | | |
|---|---|---|---|
| 2,015,950 | 9/1935 | Cavanagh et al. | 439/176 |
| 2,163,201 | 3/1936 | Kalencik | 439/176 |
| 2,229,151 | 3/1938 | Wadsworth | 439/172 |
| 2,716,737 | 8/1955 | Maberry | 439/172 |
| 3,904,263 | 9/1975 | Norman | 439/176 |
| 3,996,546 | 12/1976 | Hugly | 439/172 |
| 4,010,993 | 3/1977 | Hohenberger et al. | 439/176 |
| 4,728,163 | 3/1988 | Kittinger et al. | 439/172 |
| 4,815,983 | 3/1989 | Erickson et al. | 439/173 |

*Primary Examiner*—Steven L. Stephan
*Assistant Examiner*—J. F. Duverne

[57] ABSTRACT

An electrical connector (1) constructed with, an insulating insert (3) mounted to a connector housing (4), the insert (3) having a mating face (10) at a front of the housing (4), at least one electrical contact (2) in a contact receiving cavity through the insert (3), the contact (2) having a pin (6) and a receptacle (5), and the contact (2) being adapted for mounting in the insert (3) to provide the receptacle (5) at the mating face (10), and the contact (2) being adapted for mounting in the insert (3) to provide the pin (6) at the mating face (10).

3 Claims, 3 Drawing Sheets

CONNECTOR WITH ADAPTABLE INSERT

FIELD OF THE INVENTION

The present invention relates to an electrical connector with multiple electrical contacts, and, more particularly, to an electrical connector with multiple electrical contacts mounted in an insulating insert.

BACKGROUND OF THE INVENTION

A known electrical connector, described in U.S. Pat. No. 4,728,163, comprises, a receptacle contact constructed with a lower end that serves as a solder tail. A male plug contact is inserted within the receptacle contact and projects from a top of an insulating connector housing to provide an electrical plug connection. When the male plug contact is removed from the receptacle, the receptacle remains in the housing to provide a receptacle contact.

U.S. Pat. No. 4,728,163 discloses a solder section on a male contact. The male contact protrudes from a first insulating housing. A female contact is supported in a second insulating housing. The two housings are combined to plug the male contact with the female contact. The male contact extends through the female contact to a mating face of a connector, and to provide a plug type connector. The female contact can be adjusted in location to project from the male contact to the mating face of a connector, and to provide a receptacle type connector.

SUMMARY OF THE INVENTION

According to the invention, a unitary electrical contact is provided with both, an electrical receptacle portion, and a unitary plug portion. When the receptacle portion is positioned at a mating face of an electrical connector, the plug portion provides a rear solder tab. The contact can be turned around to face either the receptacle portion or the plug portion at the mating face. When the plug portion is positioned at the mating face, the receptacle portion provides a rear socket into which is plugged an elongated tab that projects out of the rear socket to provide a solder tab for connection to a corresponding conductor of an electrical cable.

Further, according to the invention, the unitary electrical contact is mounted in a unitary insulating insert adapted for mounting in an insulating housing of an electrical connector. The insert is adapted for mounting in a stack, together with additional duplicates of the insert.

Embodiments of the invention will now be described by way of example with reference to the accompanying drawings, according to which:

DETAILED DESCRIPTION

Figure 1:
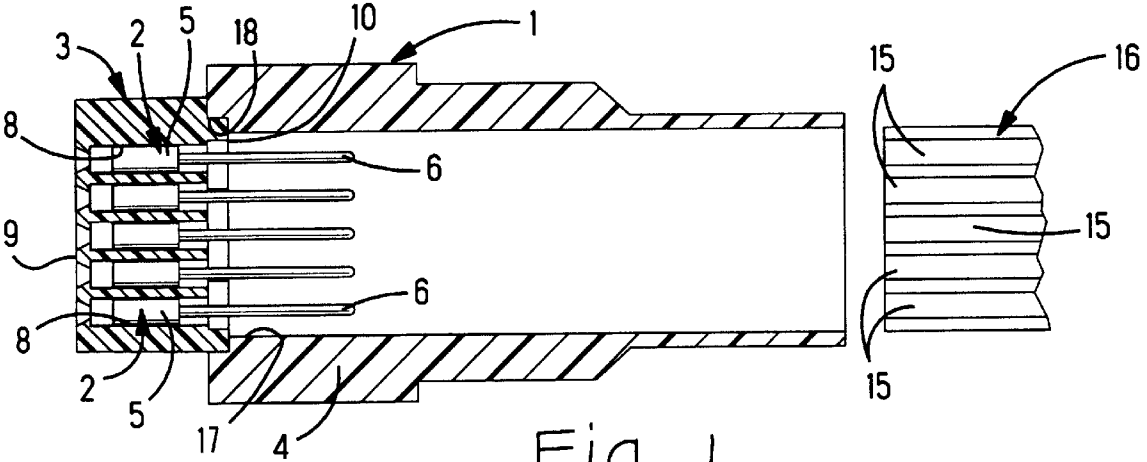
FIG. 1 is a section view of structure shown in FIGS. 2 and 3.
Figure 2:
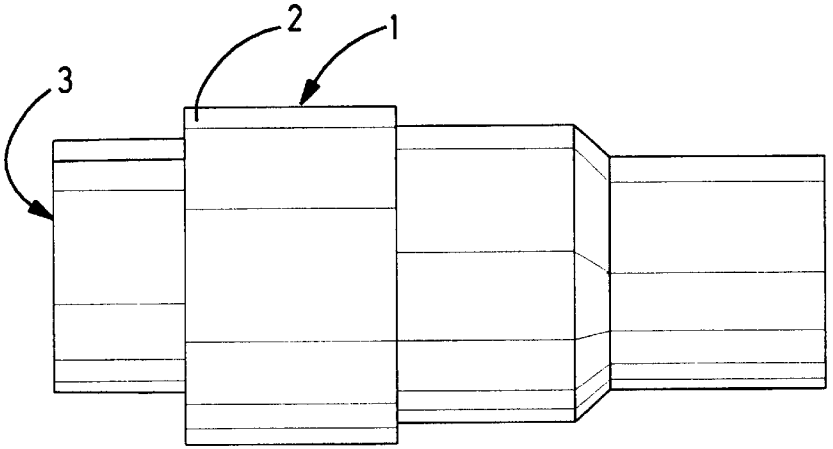
FIG. 2 is a side view of an electrical connector to provide a receptacle type electrical connector.
Figure 3:
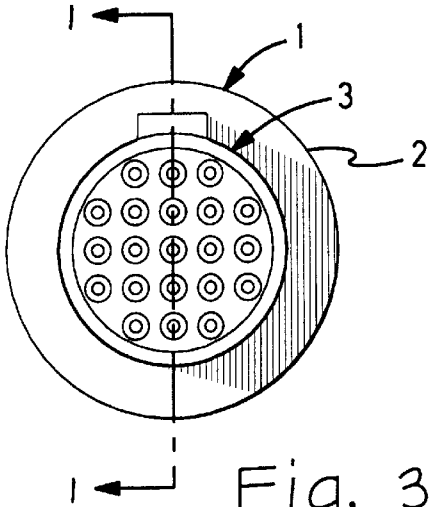
FIG. 3 is an end view of the connector as shown in FIG. 2.
Figure 4:
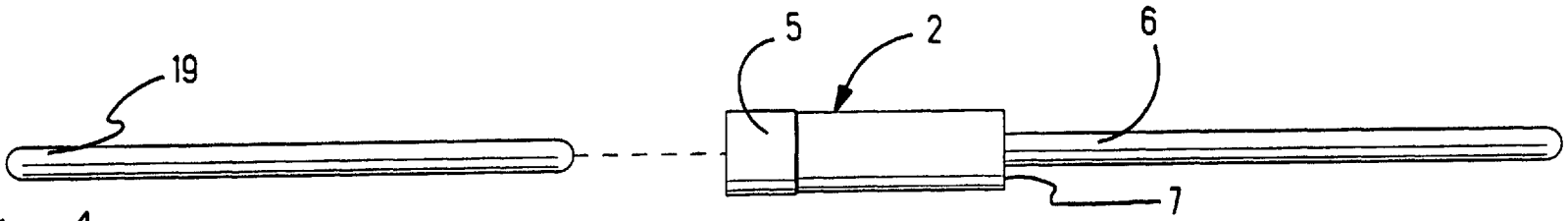
FIG. 4 is a side view of an electrical contact and a contact portion that adapts the electrical contact for use in a plug type electrical connector.
Figure 10:
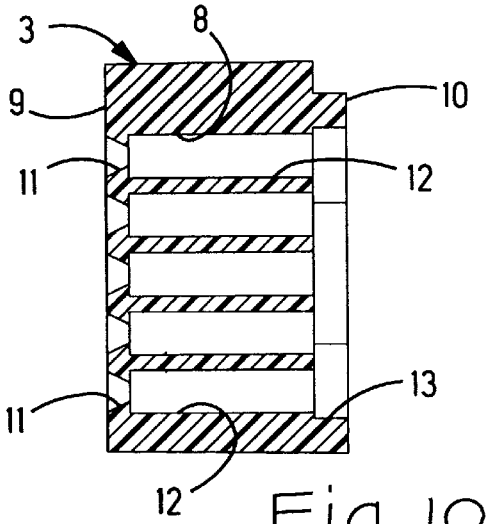
FIG. 10 is a section view taken along the line 10—10 of FIG. 9.

With reference to FIGS. 1, 4 and 10, an electrical connector 1 comprises, an electrical contact 2 mounted in an insulating insert 3, the insert 3 being mounted in an insulating connector housing 4.

Figure 5:
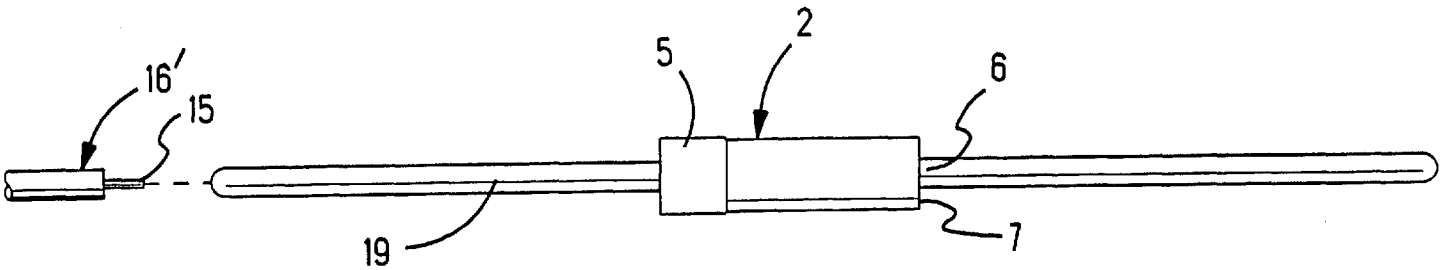
FIG. 5 is a view similar to FIG. 4, illustrating an assembly of the electrical contact and the contact portion, as shown in FIG. 4.

With reference to FIGS. 4 and 5, the contact 2 comprises a unitary, machined, conducting contact 2 having a hollow socket 5, and an elongated pin 6 extending lengthwise axially with the socket 5. The socket 5 and pin 6 are dimensioned such that a pin 6 of a first contact 2 will fit with a friction fit in a socket 5 of a second, duplicate, contact 2, to establish an electrical mating connection.

A shoulder 7 is formed at a junction of the pin 6 with the socket 5. Multiple contacts 2 are mounted along corresponding, contact receiving cavities 8 through an insulating insert 3, FIGS. 7–10.

The insert 3 is a unitary molded body having a mating face 9 and a rear face 10. Each of the contact receiving cavities 8 has a reduced diameter portion with a flared entrance 11 projecting through a thin wall at the mating face 9, and a larger diameter portion 12 at the rear face 10. An octagonal sided cavity 13 is recessed in the rear face 10. A projecting key 14 projects from the mating face 9 and extends axially along an exterior of the insert 3. As shown in FIG. 1, the contacts 2 are mounted in the cavities 8 with the socket 5 of each contact 2 at the mating face 9, and the pin 6 of each contact 2 projecting from the rear face 10. Each contact 2 registers against the thin wall at a front of the cavity 8. Each contact 2 is potted in place in the insert by a suitable adhesive potting material. As shown in FIG. 1, the pins 6 project from the rear face 10 of the insert 3 to provide solder tails to which respective conductors 15 of a flexible printed circuit 16 can be electrically connected, for example, by a soldering operation. The conductors 15 are extended through the hollow housing 4. After connection of the solder tails to respective conductors 15, the insert 3 is mounted in a front cavity 17 of an insulating connector housing 4 to provide an electrical receptacle type connector 1, with the mating face 9 at a front of the housing 4, and the pins 6 projecting into a hollow interior of the housing 4. The key 14 of the insert 3 is aligned by fitting with a keyway 18 in the front of the housing 4. The insert 3 is secured with an adhesive bond to the housing 4. In FIG. 1, the electrical connector 1 is adapted with the insert 3 to provide a receptacle type connector 1.

Figure 6:
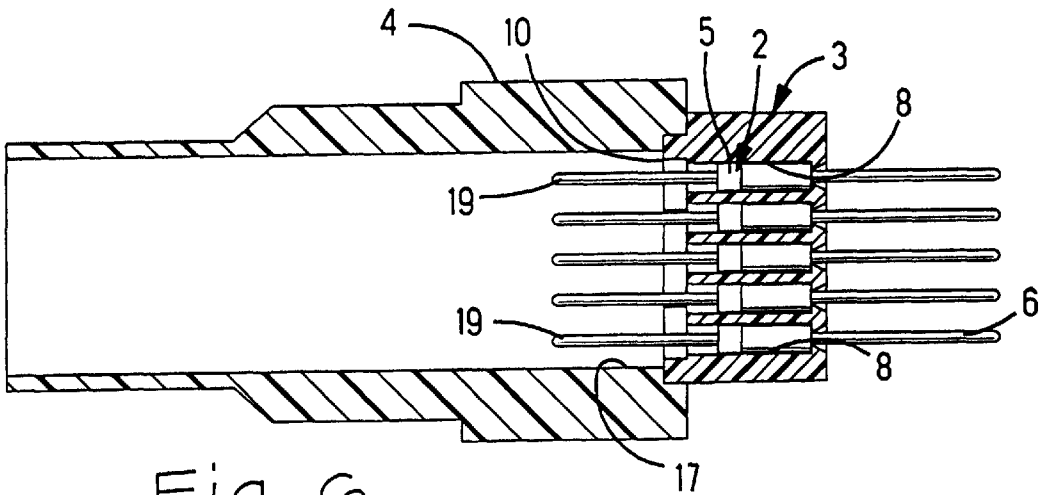
FIG. 6 is a view similar to FIG. 1, illustrating an electrical connector adapted with the structure of FIG. 5 to provide a plug type electrical connector.
Figure 8:
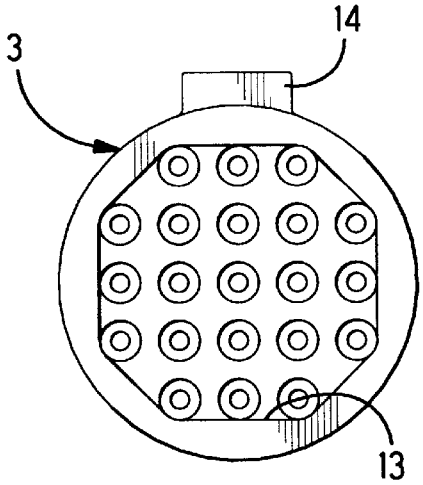
FIG. 8 is an end view of the structure shown in FIG. 7.
Figure 9:
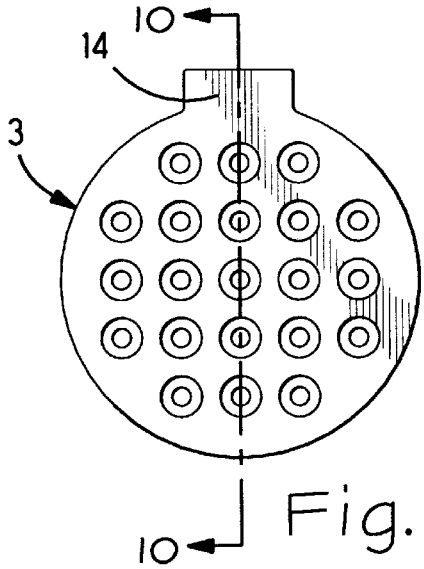
FIG. 9 is an end view of the structure shown in FIG. 7.
Figure 7:
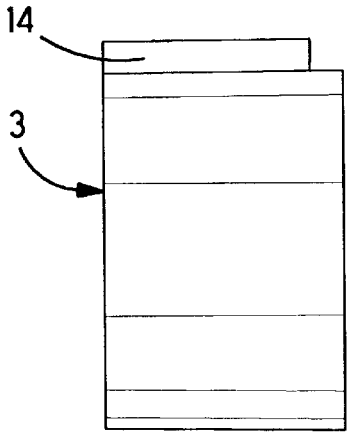
FIG. 7 is a side view of an insulating insert for each of the electrical connectors, as shown in FIGS. 1 and 6.

Alternatively, each of the solder tails can be electrically connected to a conductor 15 of an insulated wire 16, as shown in FIG. 6. With reference to FIG. 6, the electrical connector 1 is adapted with the insert 3 to provide a plug type connector 1. The insert 3 is adapted with the electrical contact 2, as shown in FIGS. 4 and 5, together with a separate pin 19 that is press fit in the socket 5 to provide a solder tail. Each contact 2 is mounted in a corresponding cavity 8 through an insert 3, and is potted in place, with the pin 6 projecting through the mating face 9, and the pin 19 providing a solder tail projecting through the rear face 10 of the insert 3.

The contact 2 is adapted for reversed mounting to provide either a receptacle type connector 1, FIG. 1, or a plug type connector 1, FIG. 6. Each solder tail can be electrically connected, for example, by a soldering operation, to a conductor 15 of an insulated wire 16', as shown in FIG. 5, or, alternatively, to the conductor 15, FIG. 1, of the flexible printed circuit 6.

As a modification, the separate pin 19 can be machined at a relatively high cost, or the pin 19 can be a drawn wire that has been cut to length.

Figure 11:
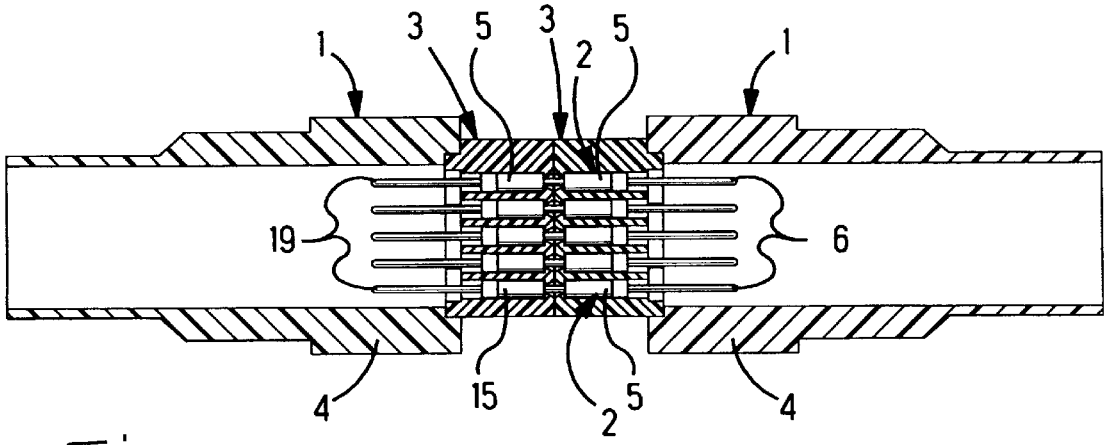
FIG. 11 is a section view of inserts in stacked relationship together with corresponding electrical connectors.

As shown in FIG. 11, the pin 6 adapts the insert 3 for use in a plug type connector 1, FIG. 6 that can mate with the sockets 5 of contacts 2 in the insert 3 of the receptacle type connector 1, FIG. 1. The inserts 3, shown in FIGS. 1 and 6, plug together, and are in stacked relationship. The inserts 3 are in different connectors 1, as shown in FIG. 11. However, the inserts 3 can also stack together without being in separate connectors 1, to adapt for use in another environment or application.

Other embodiments and modifications of the invention are intended to be covered by the spirit and scope of the appended claims.

I claim:

1. An electrical connector comprising: at least one insulating insert mounted to a connector housing, electrical contacts, each of the contacts being received within a corresponding contact receiving cavity that extends through the insert, each of the electrical contacts being unitary and having a socket and a pin extending lengthwise with the socket, the socket being adapted to mount at the mating face of the insert to provide a socket type connector with the pin providing a solder tail that projects from the insert and into a hollow interior of the housing, and the pin being adapted to mount at the mating face of the insert in place of the socket to provide a plug type connector with the socket providing an electrically connecting socket facing the hollow interior of the housing, such that each of the electrical contacts is reversible, lengthwise, in position within said corresponding contact receiving cavity that extends through the insert.

2. An electrical connector as recited in claim 1, and further comprising: the socket and the pin on each of the electrical contacts are dimensioned such that the pin on each of the electrical contacts will fit with a friction fit in the socket of each other one of the electrical contacts to establish an electrical connection, which adapts each of the contacts to mate with an identical contact on another electrical connector.

3. An electrical connector as recited in claim 1, and further comprising: with each of the sockets providing an electrically connecting socket facing the hollow interior of the housing, further pins being inserted into the sockets of said electrical contacts, the further pins providing solder tails in the housing.

* * * * *